US008277233B2

(12) United States Patent
Su

(10) Patent No.: US 8,277,233 B2
(45) Date of Patent: Oct. 2, 2012

(54) ELECTRICAL OUTLET WITH CHANGEABLE SOCKETS

(75) Inventor: Hung-Ti Su, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 209 days.

(21) Appl. No.: 12/875,089

(22) Filed: Sep. 2, 2010

(65) Prior Publication Data

US 2011/0256775 A1 Oct. 20, 2011

(30) Foreign Application Priority Data

Apr. 14, 2010 (CN) ..... 2010 1 0146387

(51) Int. Cl.
*H01R 13/44* (2006.01)

(52) U.S. Cl. ..... 439/131

(58) Field of Classification Search ..... 439/638, 439/131, 8, 31, 651, 132; 174/66, 59, 48
See application file for complete search history.

(56) References Cited

U.S. PATENT DOCUMENTS

| | | | | | |
|---|---|---|---|---|---|
| 2,652,546 | A * | 9/1953 | Christner | 439/8 |
| 3,622,684 | A * | 11/1971 | Press | 174/486 |
| 5,195,288 | A * | 3/1993 | Penczak | 52/220.1 |
| 5,230,552 | A * | 7/1993 | Schipper et al. | 312/223.6 |
| 6,028,267 | A * | 2/2000 | Byrne | 174/59 |
| 6,085,667 | A * | 7/2000 | Gevaert et al. | 108/50.02 |
| D442,143 | S * | 5/2001 | Gershfeld | D13/139.4 |
| D446,188 | S * | 8/2001 | Gershfeld | D13/139.4 |
| 6,274,809 | B1 * | 8/2001 | Pudims et al. | 174/486 |
| D460,736 | S * | 7/2002 | Pincek et al. | D13/139.4 |
| 6,923,684 | B2 * | 8/2005 | Strayer | 439/652 |
| 6,942,502 | B2 * | 9/2005 | Sharples | 439/131 |
| 7,348,487 | B2 * | 3/2008 | Drane | 174/66 |
| 7,736,178 | B2 * | 6/2010 | Byrne | 439/574 |
| 7,934,932 | B1 * | 5/2011 | Lee et al. | 439/31 |
| 8,172,604 | B2 * | 5/2012 | Byrne | 439/528 |
| 2009/0142947 | A1 * | 6/2009 | Byrne | 439/131 |
| 2011/0177703 | A1 * | 7/2011 | Lin | 439/131 |

* cited by examiner

*Primary Examiner* — Alexander Gilman
(74) *Attorney, Agent, or Firm* — Altis Law Group, Inc.

(57) ABSTRACT

An electrical outlet includes a housing and a prong fitting member detachably connected to the housing. The housing includes two end surfaces and side surfaces between the two end surfaces. Each side surface defines a two-opening or three-opening socket for inserting a plug.

5 Claims, 6 Drawing Sheets

ELECTRICAL OUTLET WITH CHANGEABLE SOCKETS

BACKGROUND

1. Technical Field

The present disclosure relates to an electrical outlet with changeable sockets.

2. Description of the Related Art

Generally, a power outlet is mounted on a wall. Most wall-mount type power outlets provide one or two sockets in one place. When the number of the appliances or the electronic devices exceeds the number of the sockets of the power outlet, there is a need of an electrical outlet that can provide more sockets.

BRIEF DESCRIPTION OF THE DRAWINGS

The components of the drawings are not necessarily drawn to scale, the emphasis instead being placed upon clearly illustrating the principles of an electrical outlet with changeable sockets. Moreover, in the drawings, like reference numerals designate corresponding parts throughout several views.

DETAILED DESCRIPTION

Figure 1:
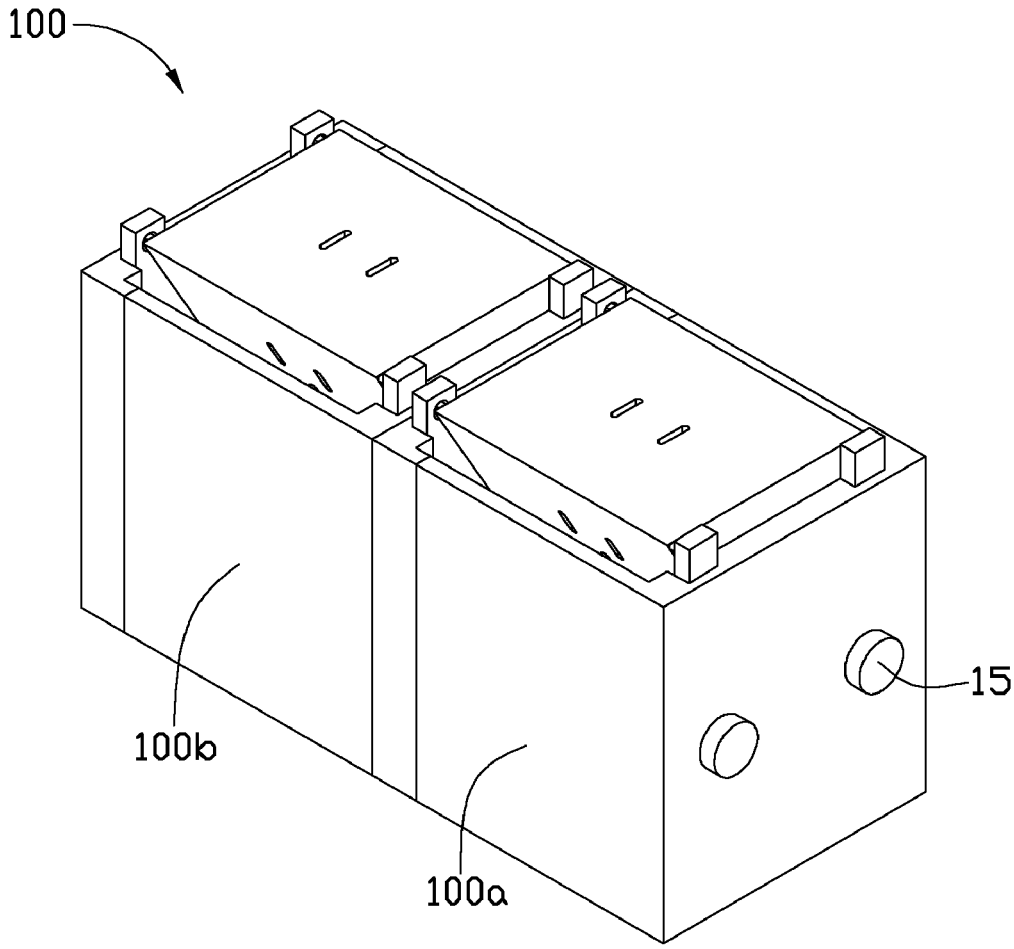
FIG. 1 is an isometric view of an electrical outlet with changeable sockets according to an exemplary embodiment.

Referring to FIG. 1, an electrical outlet 100 according to an exemplary embodiment is illustrated. The electrical outlet 100 includes a first outlet 100*a* and a second outlet 100*b* connected to each other. The first outlet 100*a* and the second outlet 100*b* have the same structure. More outlets can be connected to the outlet 100 according to need.

Figure 2:
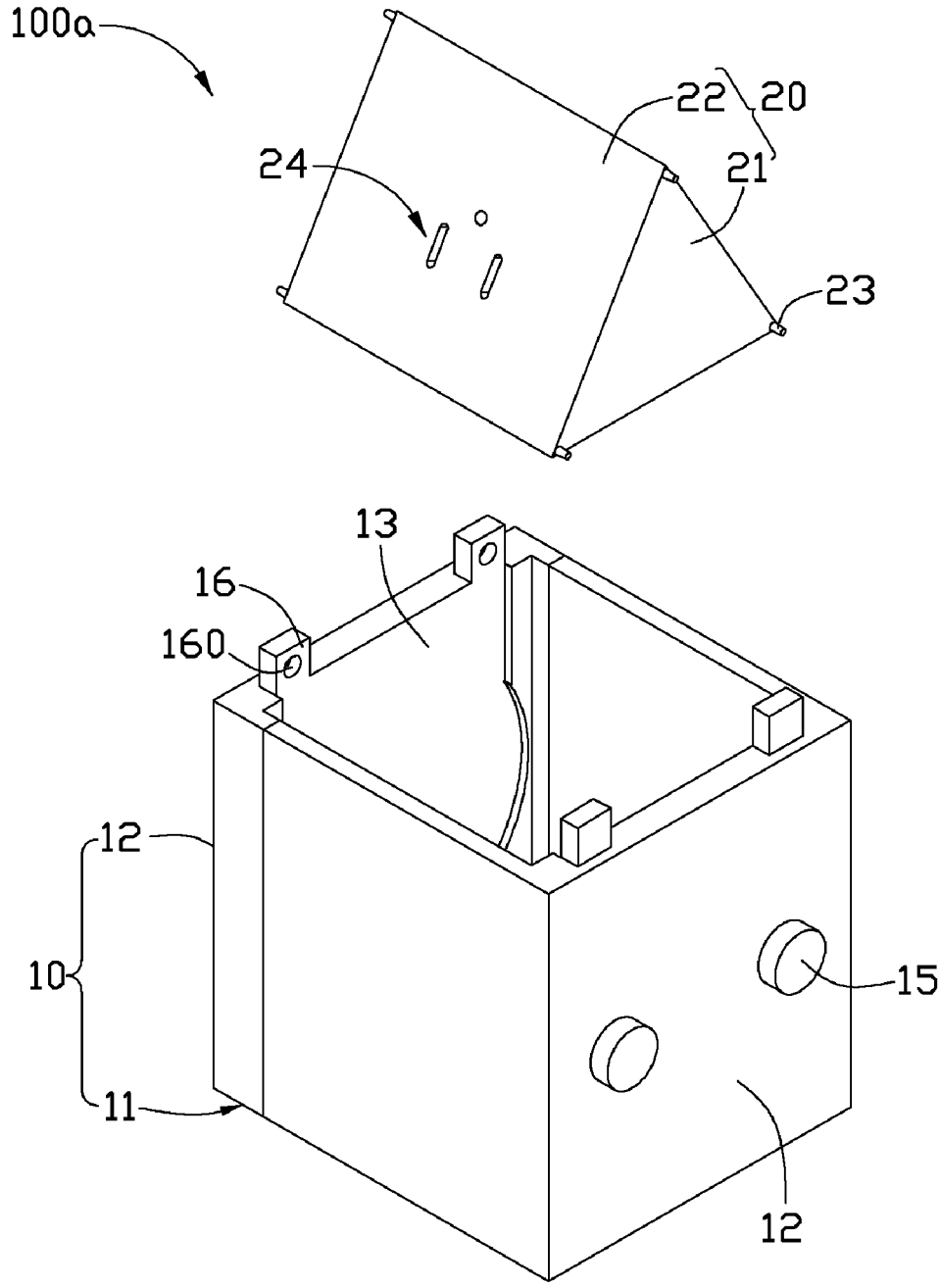
FIG. 2 is an exploded view of a first outlet of the electrical outlet of FIG. 1.

Referring to FIG. 2, the first outlet 100*a* includes a housing 10 and a prong fitting member 20 detachably connected to the housing 10. The housing 10 includes a bottom plate 11 and four side plates 12 protruding from the bottom plate 11 in a same direction, which cooperatively define a receiving space for receiving the prong fitting member 20.

Figure 3:
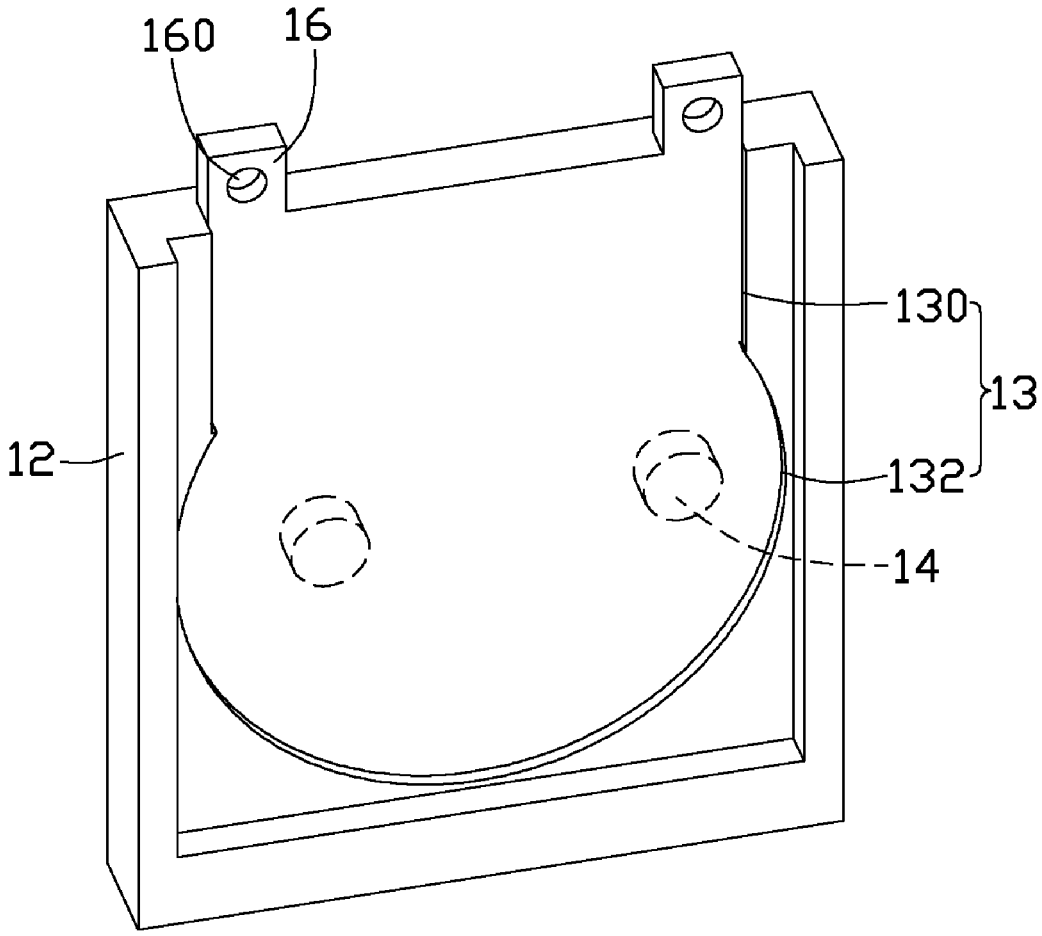
FIG. 3 is an isometric view of a sidewall of the first outlet of FIG. 2.

Referring also to FIG. 3, two opposite side plates 12 of the housing 10 each define a recessed portion 13 in an inner side thereof. The recessed portion 13 includes two first guide edges 130 and a second guide edge 132. The two first guide edges 13 extend substantially perpendicular from the top of the side plate 12 to the bottom plate 11. The second guide edge 132 is arc-shaped with two ends respectively connected to the two first guide edges 130. One of the two opposite side plates 12 defines two receiving holes 14 in an outer side, and the other of the two opposite side plates 12 includes two contact members 15 on an outer side. The first outlet 100*a* can be electrically connected to the second outlet 100*b* by fitting the two contact members 15 of the first outlet 100*a* into the two receiving holes 14 of the second outlet 100*b*.

The housing 10 further includes two pairs of positioning blocks 16 protruding from a top surface of the two opposite side plates 12. Each pair of the positioning blocks 16 defines two positioning holes 160 facing toward each other.

The prong fitting member 20 includes two end surfaces 21 and a number of side surfaces 22 between the two end surfaces 21. In the embodiment, the number of the side surfaces 22 is three. Each end surface 21 includes three elastic protrusions 23 arranged on the vertex of a triangle. In the embodiment, the protrusions 23 are made of elastic material, and can be integrally formed on the end surfaces 21. Each side surface 22 defines a two-opening or three-opening socket 24 for inserting a plug (not shown).

Figure 4:
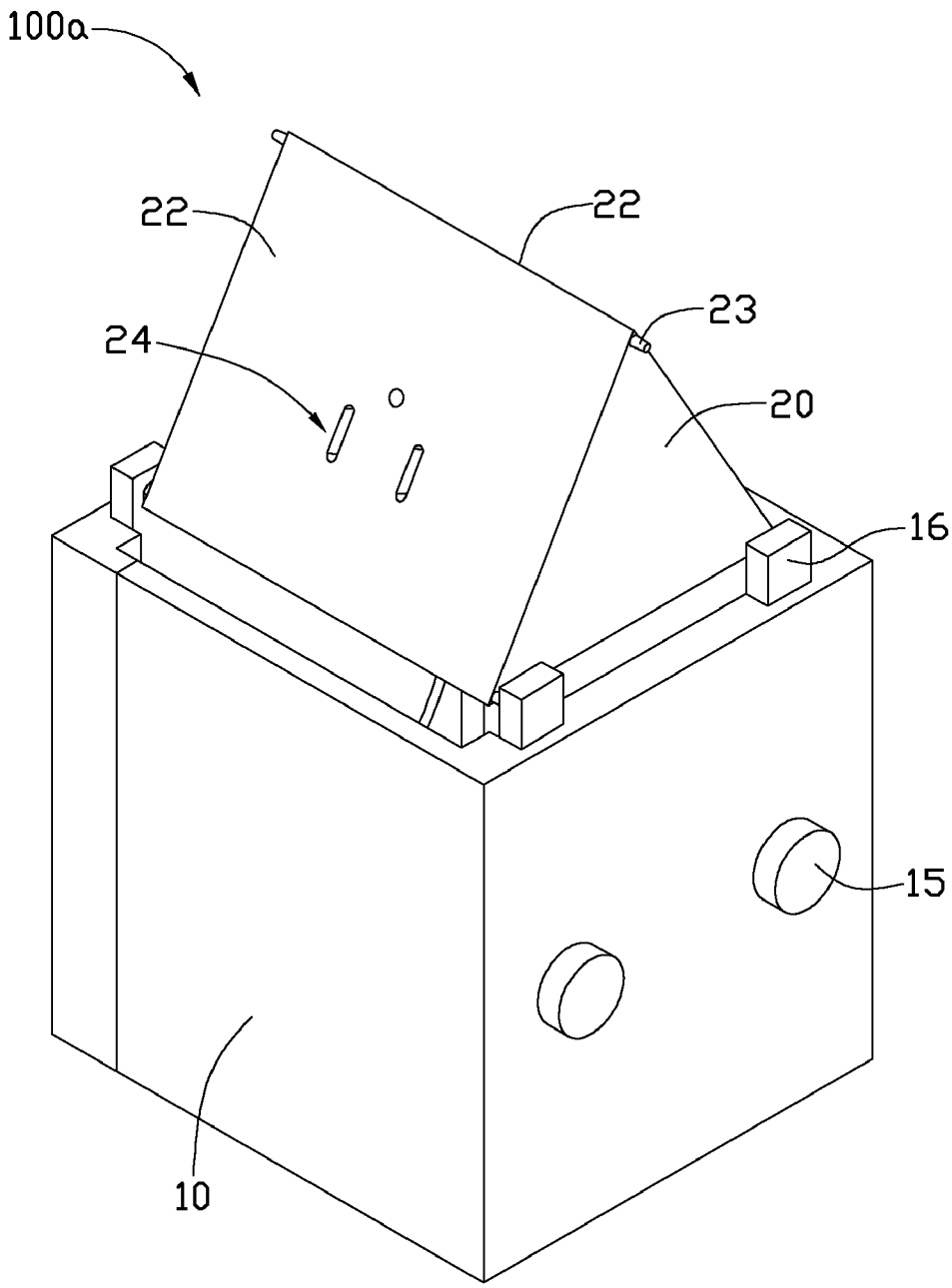
FIG. 4 is a schematic view of the first outlet of FIG. 2, providing two sockets.

Referring to FIG. 4, a schematic view of the first outlet 100*a* is illustrated. When assembled, two of the three protrusions 23 of the end surface 21 are fitted into the positioning holes 160, which fixes the prong fitting member 20 to the housing 10, and two sockets 24 (the three-opening sockets) in two of the three side surfaces 22 are exposed (one not shown).

Figure 5:
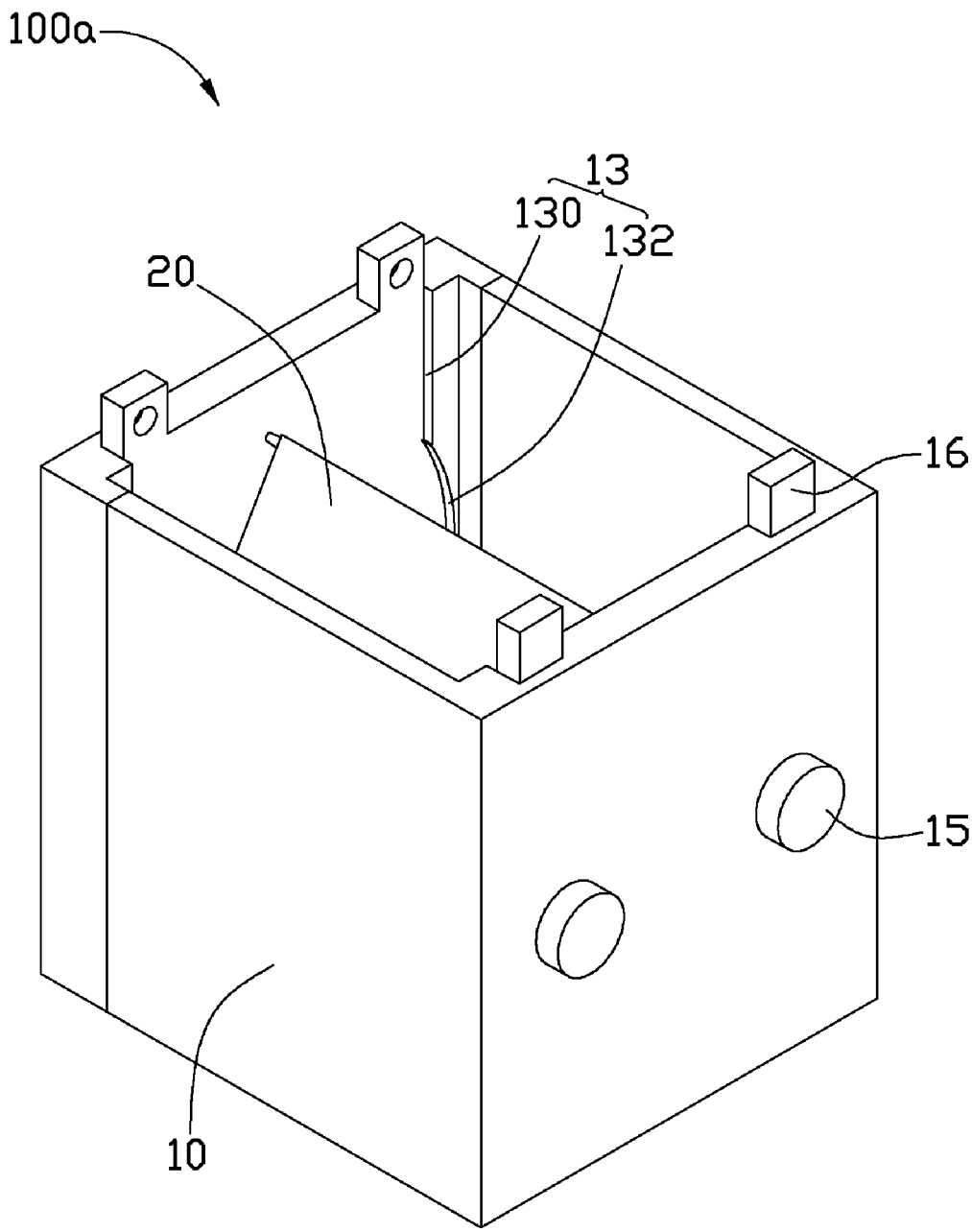
FIG. 5 is a schematic view of the first outlet of FIG. 2, showing a prong fitting member which can be rotated.

Referring to FIG. 5, by applying a downward force to the prong fitting member 20, the protrusions 23 fitted into the positioning holes 160 of the housing 10 can be deformed and disengage from the positioning holes 160. The protrusions 23 can slide along the first guide edges 130 downwardly into the second guide edge 132 of the recessed portion 13. The prong fitting member 20 can then be rotated in the housing 10 with the protrusions 23 sliding along the second guide edge 132 by an external force.

Figure 6:
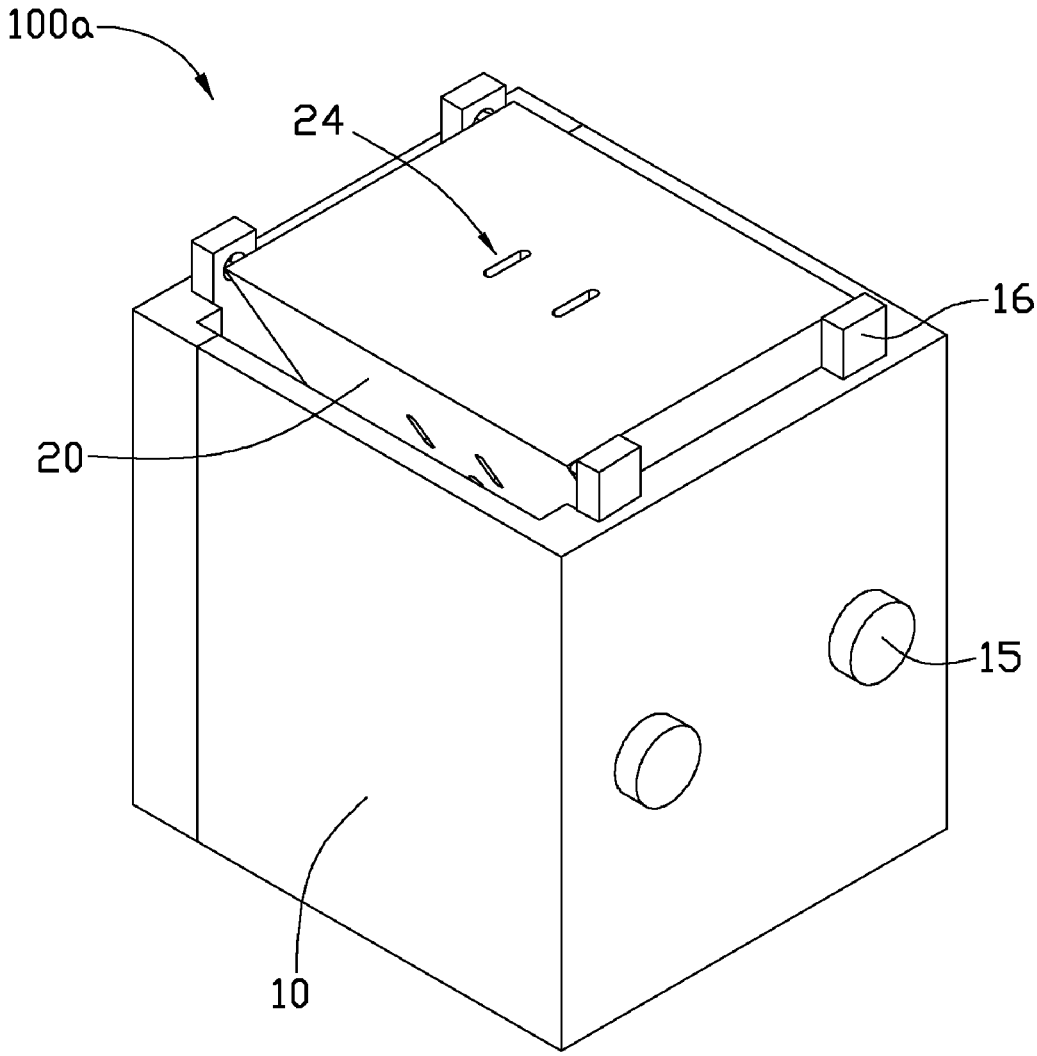
FIG. 6 is a schematic view of the first outlet of FIG. 2, providing one socket.

Referring to FIG. 6, after being rotated about 180 degrees in the housing 10, the prong fitting member 20 can upwardly slide along the first guide edges 130 until the two protrusions 23 are received in the positioning holes 160 of the housing 10, fixing the prong fitting member 20 to the housing 10. The socket 24 with two openings in the other side surface 22 is exposed.

Finally, while the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure as defined by the appended claims.

What is claimed is:

1. An electrical outlet comprising:

a housing comprising a bottom plate, four side protruding from the bottom plate in a same direction, and two pairs of positioning blocks protruding from a top of the two opposite side plates, wherein each pair of the positioning blocks defines two positioning holes facing toward each other; and a prong fitting member detachably connected to the housing, comprising:

two end surfaces; and a plurality of side surfaces between the two end surfaces, each of the plurality of side surfaces defining a two-opening socket or a three-opening socket for inserting a plug.

2. The electrical outlet as described in claim 1, wherein the number of the plurality of side surfaces is three.

3. The electrical outlet as described in claim 1, wherein each end surface comprises three elastic protrusions arranged on the vertex of a triangle, two of the three elastic protrusions are received in the two positioning holes of the housing, which detachably connects the prong fitting member to the housing.

4. The electrical outlet as described in claim 3, wherein two opposite side plates of the four side plates of the housing each define a recessed portion in an inner side thereof, each recessed portion comprises two first guide edges extending substantially perpendicularly from a top to the bottom plate and a second guide edge between the two first guide edges, two of the three protrusions of the prong fitting member are capable of sliding downwardly along the first guide edges into the second guide edge, and the prong fitting member is capable of rotating in the housing with the protrusions sliding along the second guide edge by an external force.

5. The electrical outlet as described in claim 4, wherein one of the two opposite side plates defines two receiving holes in an outer side, and the other of the two opposite side plates comprises two contact members which can be fitted into two receiving holes of another outlet.

* * * * *